United States Patent [19]

Jay

[11] Patent Number: 4,842,330

[45] Date of Patent: Jun. 27, 1989

[54] PROTECTIVE SEAT CUSHION

[75] Inventor: Eric C. Jay, Boulder, Colo.

[73] Assignee: Jay Medical, Ltd., Boulder, Colo.

[21] Appl. No.: 249,593

[22] Filed: Sep. 26, 1988

Related U.S. Application Data

[63] Continuation of Ser. No. 68,561, Jun. 30, 1987, abandoned.

[51] Int. Cl.[4] ..... A47C 1/00

[52] U.S. Cl. ..... 297/4; 297/459; 297/DIG. 3

[58] Field of Search ..... 297/4, DIG. 3, 458, 297/459; 5/451, 452, 450

[56] References Cited

U.S. PATENT DOCUMENTS

| | | | |
|---|---|---|---|
| 1,468,072 | 9/1923 | Ogle | 297/4 |
| 2,621,327 | 12/1952 | Amoroso | 297/4 X |
| 2,888,976 | 6/1959 | Hart | 297/459 |
| 3,093,407 | 6/1963 | Wilson | 297/4 |
| 3,259,425 | 7/1966 | Chitwood | 297/459 |
| 3,689,949 | 9/1972 | Weinstein et al. | 5/451 |
| 4,132,228 | 1/1979 | Green | 297/DIG. 3 |
| 4,643,481 | 2/1987 | Saloff et al. | 297/458 |

FOREIGN PATENT DOCUMENTS

| | | | |
|---|---|---|---|
| 83/03195 | 9/1983 | PCT Int'l Appl. | 297/459 |

*Primary Examiner*—Francis K. Zugel
*Attorney, Agent, or Firm*—Donald E. Egan

[57] ABSTRACT

A light-weight, low-profile seat cushion is attached to a body engaging sling. The cushion includes a foam base having a dished out central portion, and an envelope, partially filled with fluid, positioned over the dished out portion of the base. In the preferred embodiment, a self-supporting back support is attached to the rear of the seat cushion.

25 Claims, 2 Drawing Sheets

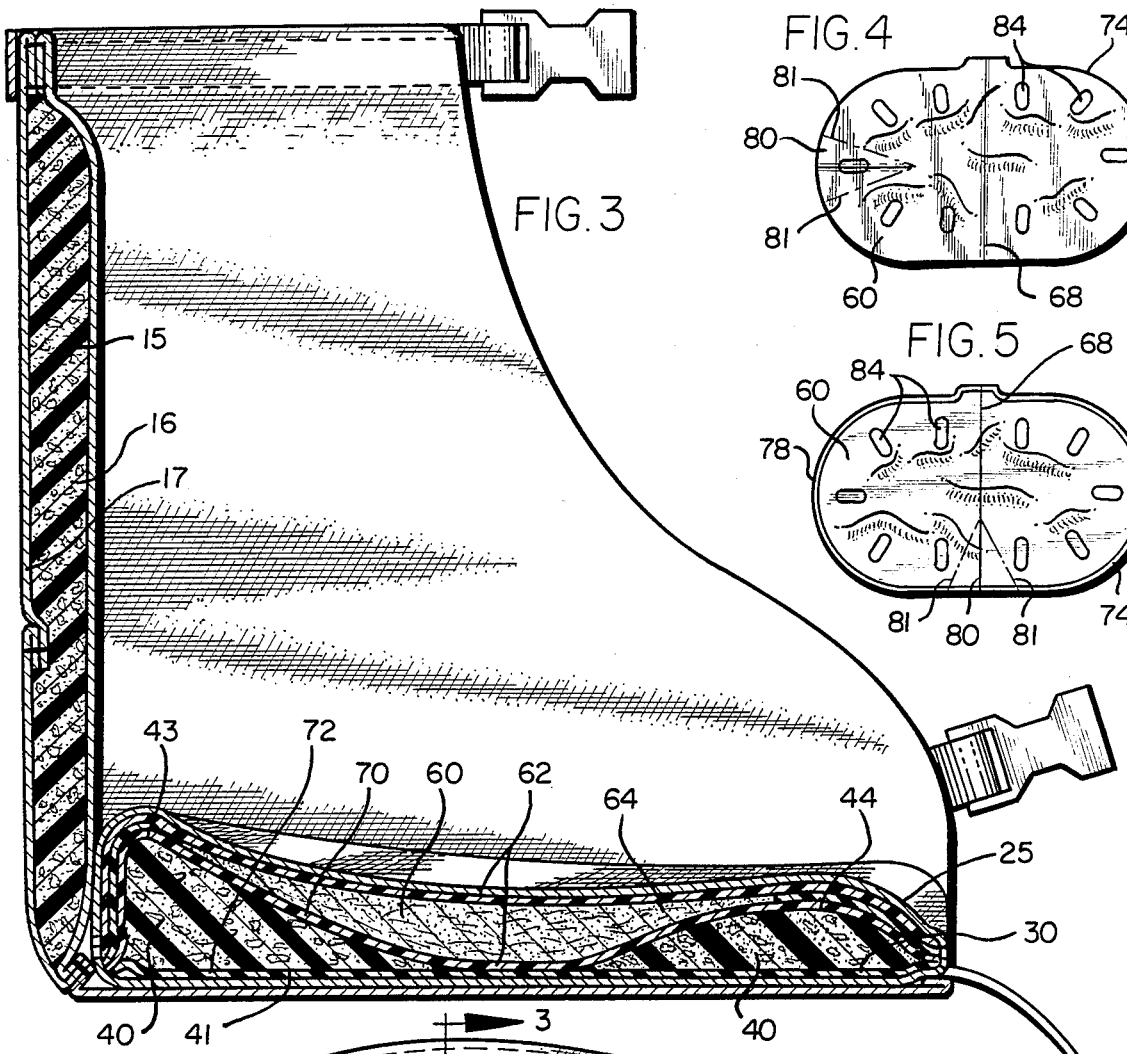
FIG. 3
15
16
17
43
72
70
60
62
64
44
25
30
40
41
40
3
FIG. 4
84
74
81
80
81
60
68
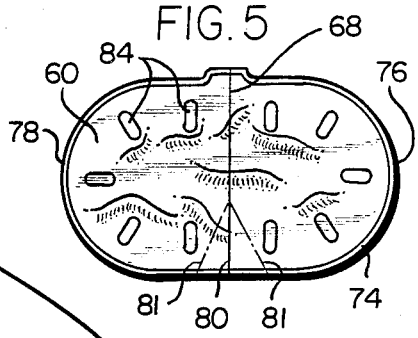
FIG. 5
68
84
60
76
78
81
80
81
74
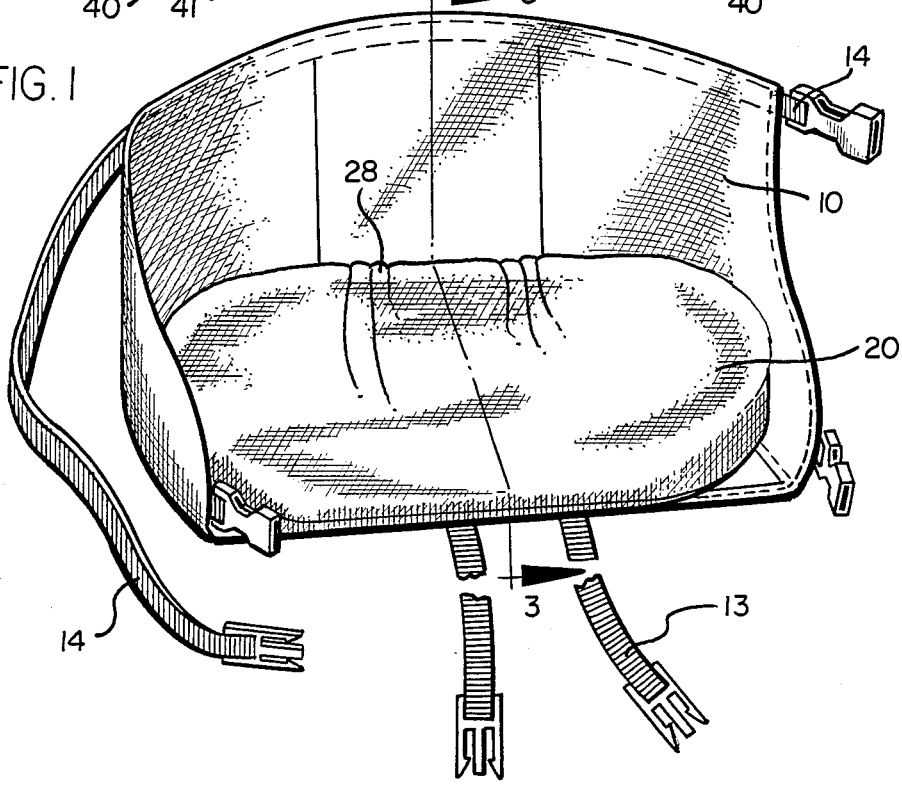
FIG. 1
14
28
10
20
3
13
14

PROTECTIVE SEAT CUSHION

This is a continuation of application Ser. No. 068,561, filed June 30, 1987, now abandoned.

The present invention provides a lightweight, compact seat cushion designed for use in wheelchairs, but provided with means to strap the cushion to the user, which allows the user to leave the wheelchair with the cushion attached to the user and provide a protective cushion to the user while out of the wheelchair.

BACKGROUND OF THE INVENTION

The present invention relates in general to a seating apparatus for paraplegics and quadraplegics for the purpose of relieving pressure in the gluteal area and preventing the development of pressure sores caused by prolonged periods of sitting. The present invention consists of a cushion and a sling attachment system, which allows attachment of the entire apparatus to the person. Although the cushion mounted to the sling attachment represents the preferred embodiment of the present invention, the cushion may also be used independently. It is especially well suited for use over car and airplane seats as well as racing wheelchairs.

Paraplegics and quadraplegics are extremely susceptible to the risk of severe pressure sores. This is due primarily to the fact that, unlike able-bodied persons, they must spend most of their time in a seated position and they cannot feel the cut-off of blood flow. Prolonged periods of sitting increase the rate of atrophy, thereby exaggerating the protrusion of boney prominences and increasing the pressure on the three bony prominences (i.e., the two ischial tuberosities and the coccyx) in posterior regions of the body. Whereas capillary blood pressures are only 40 mm Hg, normal sitting on hard or even somewhat softer surfaces may create pressures of up to 200 mm Hg, thereby causing pressure sores to develop in a matter of a few hours. The severity of these pressure sores can be appreciated considering that just fifty years ago, they represented the second most frequent cause of death in paraplegics. In addition to the serious health risk, surgical treatment of pressure sores is expensive, averaging $69,000 per treatment.

Prior art has established cushions which considerably diminish the risk of pressure sores in wheelchair users. One such patent is the Jay U.S. Pat. No. 4,588,229, which has the potential of lowering pressures to tolerable capillary blood pressure levels. As a result, there has been a marked decrease in the number of pressure sores suffered by wheelchair users. However, as successful as these cushions have been in normal wheelchair use, the recent increased participation of paraplegics in everyday activities outside the wheelchair requires a more flexible, lightweight and versatile seat cushion. Existing wheelchair cushions have proved to be inadequate for these purposes, as they are either too clumsy for a paraplegic to manuever or too thick to be used in car or restaurant seats, for example. As a result, the absence of a more portable, lightweight cushion has prevented many paraplegics from fully participating in such recreational activities as canoeing, kayaking and horseback riding, or even in the more basic activities, such as sitting or sliding across the floor, for fear of developing pressure sores.

In addition, there has been no way for a paraplegic to protect himself while moving outside his wheelchair. He could only accomplish this by pulling his cushion out from under himself, moving the cushion a few feet, transferring on to it, resting, and then moving the cushion again. This is a slow and cumbersome process that discourages movement outside the wheelchair—or even worse, results in dragging one's self across the floor without protection, thus creating pressure and shearing sores.

Prior to this invention, there has been no practical way for a paraplegic to protect his skin while moving outside his wheelchair. This protection is needed for a variety of activities, including climbing steps, crawling into the wheelchair, getting to inaccessible rooms, climbing into kayaks or racing wheelchairs, camping, horseback riding and numerous other activities in which paraplegics simply have not been able to protect their skin adequately.

It is the further object of this invention to provide stability while sitting on the floor. Unstable sitting among paraplegics is created by two factors 1. boney ischial tuberosities which result in 2-point sitting with uneven weight distribution; and
2. lack of lower back muscle control.

SUMMARY OF THE INVENTION

The present invention provides a seat cushion which is associated with a sling attachment apparatus.

The seat cushion consists of a fluid filled pad positioned within a cavity of a supporting foam base. The fluid filled pad is comprised of a flexible envelope partially filled with fluid. The cushion is secured to a sling attachment system, which allows the person to attach the entire apparatus to his body, using straps for the waist and legs.

The fluid filled pad comprises a flexible envelope which is preferably longitudinally divided or segmented into two halves by sealing the upper surface of the envelope to the lower surface of the envelope from the front edge to the rear edge along a longitudinal axis, thereby preventing the fluid from passing from one side to the other. The supporting foam base is shaped to cause the fluid within the fluid filled pad to aggregate in the area beneath the ischial tuberosities of the person. Extra material or slack is provided in the upper surface of the envelope avoids the problem of hammocking and allows for total conformation of the fluid pad to the bony prominences of the seated person. Hammocking is defined as the inability of the surface material to conform to the boney prominences.

A foam insert is preferably built into the back portion of the sling to provide additional support to the lower back. When attached to the body, the sling protects the coccyx of a person laying on his back doing floor exercises and protects the hip bones of a person laying on his side. The bottom of the sling is made of a smooth, abrasion resistant material, allowing a paraplegic to drag himself across the floor and also preventing water absorption. Velcro® strips on the seat component of the sling attachment system and on a removable cover provide a means of securing the cushion to the sling attachment.

DESCRIPTION OF THE DRAWINGS

FIG. 1 is a perspective view of the present invention illustrating the seat cushion secured to the sling attachment system.

FIG. 3 is a cross-section side view of the sling attachment system illustrating the cushion attached, section 3—3 of FIG. 1.

FIG. 4 is a top view of the fluid filled pad illustrating the sealing method of the V-shaped areas.

FIG. 5 is a top view of the fluid filled pad.

DETAILED DESCRIPTION OF THE INVENTION

Figure 2:
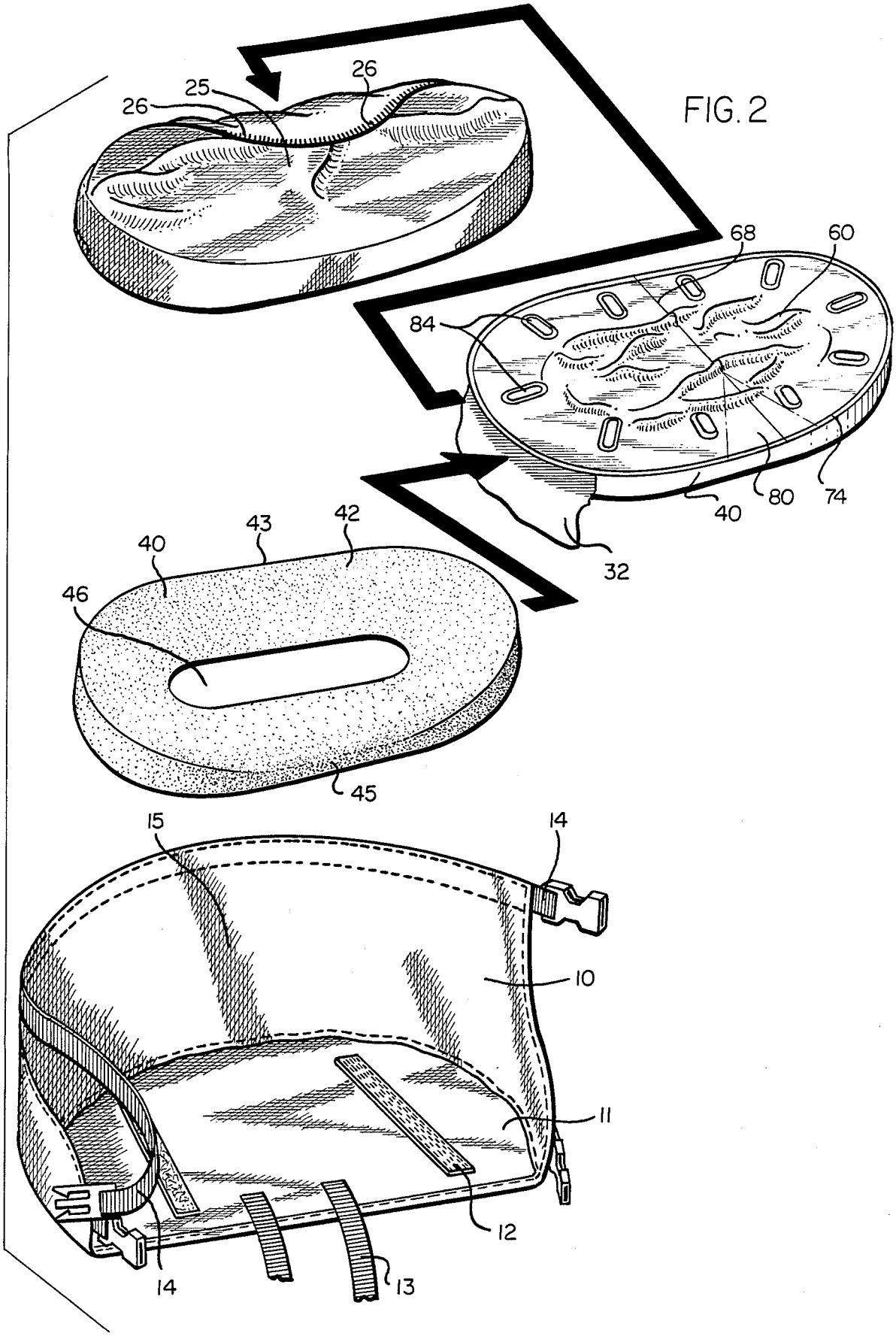
FIG. 2 is an "exploded" perspective view of the sling attachment system illustrating the cushion separated into its component parts, i.e., the supporting foam pad, the fluid filled pad with urethane cover and the removable cover.

The present invention is illustrated in FIG. 1 showing seat cushion 20 attached to sling attachment system 10. FIG. 2 shows sling attachment system 10 and an exploded view of the seat cushion 20. The seat cushion 20 comprises a supporting foam base 40 and fluid filled pad 60. In its preferred embodiment, cushion 20, including the supporting foam base 40 and fluid filled pad 60, is sealed within a waterproof (liquid impermeable) cover 30, such as polyurethane. The seat cushion 20 is preferably enclosed within a removable cover 25 in order to allow periodic cleaning, and reduce perspiration.

Velcro ® strips 12 on the sling attachment system 10 and corresponding strips on the bottom of removable cover 25 allow for attachment of the cushion 20 to the sling attachment system 10. The sling attachment system allows the entire apparatus to be attached to the body of a person by means of a waist strap 14 and two thigh straps 13. Alternatively, a single attachment strap may be used.

SUPPORTING FOAM BASE

As illustrated in FIG. 2, supporting foam base 40 preferably comprises a single piece of relatively incompressible foam. Preferably, foam base 40 is foamed in a single shot, wherein the entire base has a single density. The supporting foam base 40 is generally oval-shaped, with a flat bottom 41. As is shown in FIG. 2 and FIG. 3, foam base 40 is higher along its rear edge 43 than along the front edge 44. Side edges 45 are of intermediate height. The higher rear edge 43 forces the pelvis of a person sitting on the cushion into a forward position, thereby assisting the person in sitting erect.

As is shown in FIG. 2, the upper surface 42 of foam base 40 is dished-out in the center portion 46. The dished-out center portion 46 is positioned just beneath the ischial tuberosities of a person seated on the cushion. Since ischials in adults are between $4\frac{1}{2}$ and 6 inches apart, the dished-out center portion 46 should be between 6 and 8 inches wide so as to allow some movement from side to side, while still assuring that the ischials remain within the area of the dished-out center portion 46. Naturally, cushions for children may be sized smaller. From the edge of the scooped-out center 46 and proceeding outward, the foam base 40 slopes upward as it approaches the outer periphery. As is shown in FIG. 3, the dished-out center portion 46 creates a depression or cavity in the center portion 46 of the supporting foam base 40 large enough to accomodate a fluid filled pad 32.

THE FLUID FILLED PAD

The fluid filled pad 60 comprises an elastomeric envelope 62 partially filled with fluid 64. Envelope 62 comprises two layers of film, upper layer 70 and lower layer 72 of the envelope, which are securely heat sealed together along the entire outer edge 74. The envelope 62 is preferably divided into two equal halves along a longitudinal axis 68 by sealing the upper surface 70 of envelope 62 to the lower surface 72 of envelope 62 from the front edge to the rear edge, in order to prevent the fluid 64 from passing from one side to the other. Segmenting envelope 62 into equal halves traps fluid 64 within each half and causes the fluid within each half to aggregate beneath the area of the ischial tuberosities.

In the preferred embodiment, envelope 62 includes segments 84 formed by heat sealing the upper surface 70 to the lower surface 72 at a plurality of points about its periphery as illustrated in FIG. 5. As shown in FIG. 5, short segments 84 may be positioned around the oval center, at right angles to the periphery of envelope 62. Segmenting, as illustrated by FIG. 5, limits the amount of fluid 64 in the area of the segments 84 and thus causes the fluid 64 to remain in the central portion of envelope 62 where it is superimposed above the dished-out center portion 46 of supporting foam base 40.

The role of segments 84 is to confine the fluid under the ischial tuberosities. By entrapping the fluid in this area, the weight and height of the cushion is limited without sacrifice of the comfort and stability. Alternatively, the fluid could be eliminated from the outer portion of envelope 62 and confined to an 8 inch central portion positioned above central portion 46 of foam base 40.

In the preferred embodiment, the fluid filled pad 60 and the supporting foam base 40 are sealed within waterproof cover 30. In one embodiment, polyurethane material 32, which extends beneath supporting foam base 40, may be heat sealed to envelope 62, thereby enclosing the entire seat cushion 20 in a film of waterproof urethane. Alternatively, waterproof cover 30 may comprise a separate envelope of waterproof film adapted to cover supporting foam base 40, alone, or to enclose the combination of supporting foam base 40 and fluid filled pad 60. Waterproof cover 30 prevents the foam pad 40 from absorbing water when used in connection with water sports or as a bathtub cushion. An alternative method of waterproofing would be to seal an entire pouch around the cushion and base.

In the preferred embodiment, extra material is provided in the surface of the envelope 62 to avoid the problem of hammocking and allow for total conformation of the fluid 64 within the fluid filled pad 60 to the bony prominences of the body. This extra material also reduces shearing of skin against bone as the sitter moves or shifts on the cushion. The extra material may be provided to the upper surface of envelope 62 by forming V-shaped notches 80 in the front and/or rear of fluid filled pad 60, shown in FIG. 5. The V-shaped areas 80 are formed by heat sealing upper surface 70 to lower surface 72 along the front 76 and rear 58 of envelope 62. The sides 81 of the V-shaped areas may be joined, that is, the V-shaped portion is cut out and sides 81 be heat sealed together, to provide extra material in the central portion of the fluid filled pad. Both of the V-shaped areas 80 may be cut out to provide additional material for the central portion of said envelope. Similarly, V-shaped notches may be applied to the sides of envelope 62, as shown in FIG. 4. Alternatively, envelope 62 may be produced by heat sealing a domed top layer to a flat bottom layer to provide the desired extra material.

The envelopes used to produce the fluid filled pads of the present invention are preferably heat sealable at the edges and are adapted to retain the fluid filling material within a defined environment. It has been found that suitable thermoplastic polyurethane films have a thickness of about 0.004 to 0.015 inch and Durometer hardness (Shore A Scale) of 85 or lower. Commercially available polyurethane films have tensile strength in the range of 6,000–9,000 psi, a typical 300% modulus of 1,800 to 2,800 psi, and a typical elongation at break of 400% to 650%.

THE FLUID FILLING MATERIAL

In its broadest aspect, the present invention contemplates use of any fluid to fill the pad. However, it is preferred to employ as the fluid a highly viscous liquid, i.e., plastic or viscous thixotropic material, which flows gradually when pressure is applied to it, but which maintains its shape and position in the absence of pressure. One such viscous fluid is described in U.S. patent application Ser. No. 017,711 filed Feb. 24, 1987. Another useful fluid is commercially available under the tradename FLOLITE®, the registered trademark of Alden Laboratories. Suitable flowable materials are described in the U.S. patents listed below, which are incorporated by reference herein:

U.S. Pat. No. 3,237,319
U.S. Pat. No. 3,402,411
U.S. Pat. No. 3,635,849
U.S. Pat. No. 3,798,799
U.S. Pat. No. 4,038,762
U.S. Pat. No. 4,083,127
U.S. Pat. No. 4,108,928
U.S. Pat. No. 4,144,658
U.S. Pat. No. 4,229,546
U.S. Pat. No. 4,243,754
U.S. Pat. No. 4,255,202

Gases such as air may also be used to fill the pad, although deviations in volume caused by changes in altitude will require constant adjustment

THE SLING ATTACHMENT SYSTEM

The sling attachment system 10 comprises a bottom 11, back support 15, and attachment straps 13 and 14. Sling attachment system 10 cooperates with seat cushion 20 to allow the person to attach the entire apparatus (sling attachment 10 with secured cushion 20) to his body for use outside the wheelchair. The bottom 11 is provided with Velcro® strips 12 which correspond to similar strips attached to the bottom of the removable cover 25. The hook and loop components of the Velcro® strips 12 may be alternated as described above.

The sling attachment system 10 is attached to the body using one waist strap 14 and two thigh straps 13, as shown in FIG. 1. This arrangement offers the most secure method of attachment, although a single strap may provide an available alternative.

The bottom 11 and the outside portion of the back support 15 are constructed of a smooth, abrasion resistant material, such as 400 denier packcloth, with a urethane coating. This not only prevents moisture from seeping through the fabric, but also assists a paraplegic in dragging himself across the floor.

Back support 15 is connected to bottom 11, along the sides and the back, and preferably extends upward approximately 8 inches. The back support 15 is preferably a closed cell foam insert 16 approximately $\frac{3}{8}$ inch in thickness enclosed within a smooth abrasion resistant cover 17. A closed cell material, such as Ensolite®, is preferred as it will not absorb water during participation in water sports or when in the laundry. A firm foam is preferred to give extra low back support while sitting on the floor.

A REMOVABLE COVER

A removable cover 25 is comprised of a stretchable fabric which expands to conform to any shape the pad may assume without increasing the sitting pressure. It is also preferred that extra material in the form of tucks 28 be sewn into the back of the cover. Ideally, the cover is non-absorbant and readily washable. Cover 25 fits around seat cushion 20 and is closed in the back by means of a zipper 26, as shown in FIG. 2. The bottom of the removable cover 25 has means of securing the cushion 20 to the sling attachment 10. In the preferred embodiment, the means of securing the cushion 20 to the sling 10 are two parallel Velcro® strips 12, as shown at the bottom of FIG. 2. Also as shown in FIG. 2, the hook and loop components of the Velcro® strips may be alternated. This assures that the cushion 20 will only be secured in one way (i.e., preventing higher back of foam pad 40 from being positioned in the front) and prevents latching of the hook to articles of clothing during washing by securing the hook to the loop.

The scope of the invention herein shown and described is to be considered only as illustrative. It will be apparent to those skilled in the art that numerous modifications may be made therein without departure from the spirit of the invention and the scope of the appended claims.

I claim:

1. A light-weight. low-profile seat cushion consisting of a cushion and a sling attachment system comprising:

said cushion comprising:

an envelope partially filled with fluid, said envelope having a plurality of short segments about its periphery, thus limiting the flow of said fluid into the portion of said envelope adjacent to its periphery; and a supporting foam base comprising a flat bottom and a centrally positioned dished-out oval portion in the upper surface;

said fluid filled envelope positioned upon said foam base, said envelope being centered over said dished-out oval portion, whereby said fluid is substantially maintained over said dished-out oval portion;

said sling attachment system comprising body engaging straps and means to affix said straps to said cushion and said cushion cooperating with said sling attachment system to provide a portable cushion attachable to the body of the user.

2. A seat cushion as described in claim 1, whreein said fluid filled envelope is longitudinally segmented to divide said envelope into two halves.

3. A seat cushion as described in claim 1, wherein said fluid is a viscous liquid which flows gradually when pressure is applied to it, but which maintains its shape and position in the absence of pressure.

4. A seat oushion as described in claim 1, wherein said supporting foam base is higher along the rear edge and lower along the front edge.

5. A seat cushion as described in claim 1, wherein the bottom of said sling attachment is coated with a smooth, abrasiion resistant material.

6. A seat cushion as described in claim 1, wherein the bottom of said sling attachment is waterproof.

7. A seat cushion as described in claim 1, wherein extra material is provided in the center of the envelope.

8. A light-weight, low profile seat cushion consisting of a cushion and a sling attachment system comprising:

said cushion comprising:

an envelope partially filled with fluid; and a supporting foam base comprising a flat bottom and a centrally positioned dished-out oval portion in the upper surface, said supporting foam base being higher along the rear edge and lower along the front edge side edges of intermediate height;

said fluid filled envelope positioned upon said foam base;

said sling attachment system comprising body engaging straps and means to affix said straps to said cushion; and said cushion cooperating with said sling attachment system to provide a portable cushion attachable to the body of the user.

9. A seat cushion as described in claim 8, said envelope being centered over said dished-out oval portion, whereby said fluid is substantially maintained over said dished-out oval portion.

10. A seat cushion as described in claim 8, wherein said fluid filled envelope is longitudinally segmented to divide said envelope into two halves.

11. A seat cushion as described in claim 8, wherein said envelope is segmented about its periphery, thus limiting the flow of said fluid into the portion of the envelope adjacent to the periphery.

12. A seat cushion as described in claim 8, wherein said fluid is a viscous liquid which flows gradually when pressure is applied to it, but which maintains its shape and position in the absence of pressure.

13. A seat cushion as described in claim 8, wherein extra material is provided in the center of the envelope.

14. A light-weight, low-profile seat cushion consisting of a cushion, a self-supporting back support and a sling attachment system comprising:

a cushion;

a self-supporting back support, said back support disposed adjacent to the rear of said cushion and extending along both sides of said cushion, said back support being fixed in a vertical position with respect to said cushion;

a sling attachment system comprising body engaging straps and means to affix said straps to said cushion; and said cushion cooperating with said sling attachment system to provide a portable cushion attachable to the body of the user.

15. A seat cushion as described in claim 14, wherein said cushion comprises:

an envelope partially filled with fluid; and a supporting foam base comprising a flat bottom and a centrally positioned dished-out oval portion in the upper surface.

16. A seat cushion as described in claim 14, wherein said back support is constructed of firm, closed cell foam.

17. A seat cushion as described in claim 15, wherein said fluid filled envelope is longitudinally segmented to divide said envelope into two halves.

18. A seat cushion as described in claim 15, wherein said envelope is segmented about its periphery, thus limiting the flow of said fluid into the portion of the envelope adjacent to the periphery.

19. A seat cushion as described in claim 15, wherein said fluid is a viscous liquid which flows gradually when pressure is applied to it, but which maintains its shape and position in the absence of pressure.

20. A seat cushion as described in claim 15, wherein extra material is provided in the center of the envelope.

21. A light-weight, low-profile seat cushion consisting of a cushion and a sling attachment system comprising:

said cushion comprising:

an envelope partially filled with fluid; and a supporting foam base comprising a flat bottom and a centrally positioned dished-out oval portion in the upper surface;

said fluid filled envelope positioned upon said foam base, said envelope having extra material in the center, said envelope being centered over said dished-out oval portion, whereby said fluid is substantially maintained over said dished-out oval portion;

said sling attachment system comprising body engaging straps and means to affix said straps to said cushion; and said cushion cooperating with said sling attachment system to provide a portable cushion attachable to the body of the user.

22. A seat cushion as described in claim 21, wherein extra material is provided to the center of said envelope by removing V-shaped areas from the surface of said envelope and heat sealing the resultant edges together.

23. A seat cushion as described in claim 21, wherein said fluid filled envelope is longitudinally segmented to divide said envelope into two halves.

24. A seat cushion as described in claim 21, wherein said envelope is segmented about its periphery, thus limiting the flow of said fluid into the portion of the envelope adjacent to the periphery.

25. A seat cushion as described in claim 21, wherein said flow is a viscous liquid which flows gradually when pressure is applied to it, but which maintains its shape and position in the absence of pressure.

* * * * *